US008262856B2

(12) United States Patent
O'Leary et al.

(10) Patent No.: US 8,262,856 B2
(45) Date of Patent: Sep. 11, 2012

(54) PROCESSES AND SYSTEMS FOR THE BLEACHING OF LIGNOCELLULOSIC PULPS FOLLOWING COOKING WITH SODA AND ANTHRAQUINONE

(75) Inventors: Pam O'Leary, Queensbury, NY (US); Namhee Shin, Clifton Park, NY (US); C. Bertil Stromberg, Diamond Point, NY (US)

(73) Assignee: Andritz Inc., Glens Falls, NY (US)

( * ) Notice: Subject to any disclaimer, the term of this patent is extended or adjusted under 35 U.S.C. 154(b) by 357 days.

(21) Appl. No.: 12/133,649

(22) Filed: Jun. 5, 2008

(65) Prior Publication Data

US 2009/0032208 A1 Feb. 5, 2009

Related U.S. Application Data

(60) Provisional application No. 60/944,589, filed on Jun. 18, 2007.

(51) Int. Cl.
*D21C 9/10* (2006.01)
*D21C 9/147* (2006.01)
*D21C 9/14* (2006.01)

(52) U.S. Cl. ..... 162/88; 162/82; 162/87

(58) Field of Classification Search ..... 162/82, 162/87, 88

See application file for complete search history.

(56) References Cited

U.S. PATENT DOCUMENTS

| | | | | |
|---|---|---|---|---|
| 4,012,280 | A | 3/1977 | Holton | |
| 4,127,439 | A | 11/1978 | Fujii et al. | |
| 4,310,383 | A | 1/1982 | Fujii et al. | |
| 5,179,021 | A * | 1/1993 | du Manoir et al. | 435/278 |
| 6,010,594 | A | 1/2000 | Henricson et al. | |
| 6,153,300 | A | 11/2000 | Stromberg et al. | |
| 6,174,409 | B1 * | 1/2001 | Sundaram et al. | 162/49 |
| 6,241,851 | B1 | 6/2001 | Marcoccia | |
| 6,306,253 | B2 | 10/2001 | Henricson | |
| 6,432,266 | B1 * | 8/2002 | Fukushima et al. | 162/65 |
| 6,464,827 | B1 * | 10/2002 | Colodette | 162/63 |
| 6,544,384 | B2 * | 4/2003 | Henricson et al. | 162/17 |
| 6,576,084 | B1 | 6/2003 | Stromberg et al. | |
| 6,736,934 | B1 | 5/2004 | Henricson et al. | |
| 6,776,876 | B1 | 8/2004 | Vuorinen et al. | |
| 2001/0020521 | A1 * | 9/2001 | Henricson | 162/19 |
| 2002/0026991 | A1 | 3/2002 | Stromberg et al. | |

(Continued)

FOREIGN PATENT DOCUMENTS

EP 0 786 029 B1 7/1997

(Continued)

OTHER PUBLICATIONS

V.R. Parthasarathy, Soda-AQ Pulping and Elemental Chlorine Free (ECF) Bleaching of Softwood to Achieve Minimum Impact Mill, 1996, TAPPI Minimum Effluent Mills Symposium Proceedings, whole document.*

(Continued)

*Primary Examiner* — Anthony Calandra
(74) *Attorney, Agent, or Firm* — Nixon & Vanderhye P.C.

(57) ABSTRACT

Process for bleaching of pulps following cooking of the lignocellulosic material with soda and anthraquinone. The process may produce a whiteness on par with the bleaching of kraft pulp when using a similar bleaching sequence. In some instances, the bleaching sequence may be O-A-Do-Eop-D, O-A-ZDo-Eop-D, A-Do, or A-ZDo.

24 Claims, 1 Drawing Sheet

U.S. PATENT DOCUMENTS

2007/0284068 A1* 12/2007 Francis et al. ..... 162/17

FOREIGN PATENT DOCUMENTS

| | | |
|---|---|---|
| WO | WO 96/12063 | 4/1996 |
| WO | WO 96/27046 | 9/1996 |
| WO | WO 2004/079087 | 9/2004 |
| WO | WO 2005/059241 | 6/2005 |

OTHER PUBLICATIONS

Alain Marechal, Acid Extraction of the Alkaline Wood Pulps (Kraft or Soda/AQ) Before or During Bleaching, Reason and Opportunity, 1993, Journal of Wood Chemistry and Technology, 13(2), p. 261-281.*

Gullichsen et al., Chemical Pulping 6A, 1999, Fapet Oy, A635-A661.*

Parthasarathy, Bibliography sheet from Publisher showing the publication date of Soda-AQ Pulping and Elemental Chlorine Free Bleaching of Softwood to Achieve Minimum Impact Mill, 1996, TAPPI.*

European Search Report for EP Application No. 08 01 0953 (Sep. 24, 2008).

"Journal of Wood Chemistry and Technology", Memorial Issue Dedicated to Professor Kyosti V. Sarkanen, vol. 13, No. 1, 1993.

* cited by examiner

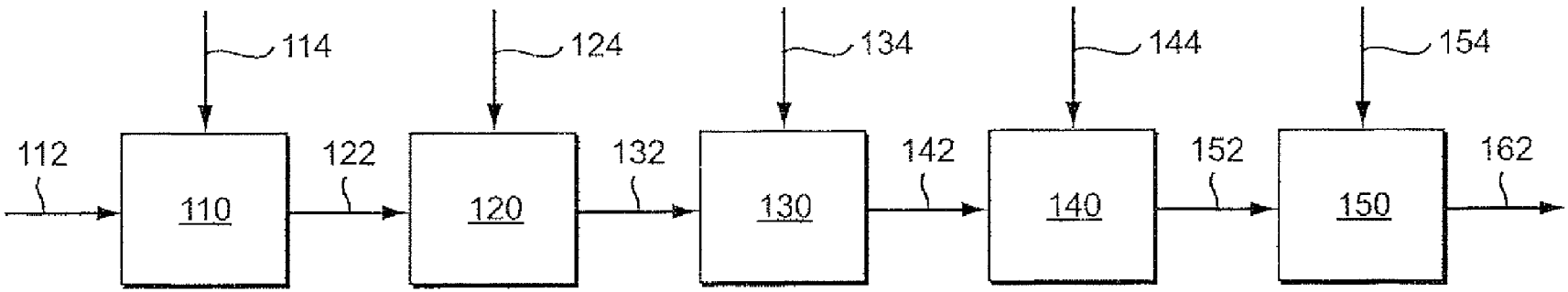
112
110
114
122
120
124
132
130
134
142
140
144
152
150
154
162

PROCESSES AND SYSTEMS FOR THE BLEACHING OF LIGNOCELLULOSIC PULPS FOLLOWING COOKING WITH SODA AND ANTHRAQUINONE

RELATED APPLICATION

This application claims the benefit of priority to U.S. Provisional App. No. 60/944,589, filed on Jun. 18, 2007, the entirety of which is incorporated herein by reference.

FIELD OF INVENTION

The disclosure below relates generally to the bleaching of lignocellulosic (e.g., wood) pulps. In especially preferred embodiments, the present invention relates to bleaching of pulps following cooking of the lignocellulosic material with soda and anthraquinone.

BACKGROUND OF THE INVENTION

In the pulp and paper industry, there are basically two fundamentally different processing methods for converting lignocellulosic material, being wood or nonwood, into pulp used in papermaking. One processing method is chemical pulping, which uses chemicals such sodium hydroxide, sodium sulfide, sodium sulfite or different solvents, to break down bonding between each individual fiber. The other processing method is mechanical pulping, which uses mainly mechanical means such as a pair of rotating discs commonly referred to as a refiner, or a rotating grinding stone, to separate the lignocellulosic fibers from one another.

The kraft chemical pulping process (also known as the sulfate process) is typical of a chemical pulp process that produces pulps of high strength and yields of around 50%. In the kraft process the wood is chemically treated under temperature and pressure with an aqueous solution of sodium hydroxide (NaOH) and sodium sulfide ($Na_2S$). However, it is sometimes possible to incrementally increase the yield of the kraft process by introducing additives or chemical treatments to the process, typically before treatment with the sulfide and hydroxide. Thus, single-digit increase in yield may have a significant impact upon the profitability of a pulp mill. If a pulp mill capacity is limited due to limitations in increasing the capacity of its recovery boiler, an increase in the yield of a pulping process can increase the capacity of the mill while avoiding the limitations of the recovery system. Another chemical pulping process, where essentially no sulfur is contained in the cooking liquor, is referred to as soda cooking. In this process sodium hydroxide (NaOH), or sodium carbonate, or a combination of the two is used to produce pulp.

U.S. Pat. No. 4,012,280 discloses that improved yield of an alkaline chemical pulping process can be obtained by adding cyclic keto compounds, including anthraquinone (AQ), to the cooking liquor and treating cellulose material with the cooking liquor-AQ solution at pulping temperatures. However, in such a process the AQ additive is not recovered and is simply lost to the pulping process, even though it is known that AQ is a catalyst. U.S. Pat. No. 4,127,439 improved on the earlier AQ treatment process by limiting the exposure of cellulose material to AQ only in a pretreatment stage prior to digestion. In this process, the pretreatment liquor is separated from the cellulose material prior to digestion and the separated pretreatment liquor containing residual AQ is re-used for pretreatment. U.S. Pat. No. 4,127,439 includes the option of pretreating cellulose in a continuous process in which the treatment liquid counter-currently displaces the pretreatment liquor in a single treatment zone. However, the removal and recovery of the pretreatment liquor is limited due to the treatment in one treatment zone.

U.S. Pat. No. 4,310,383 discloses an alternative to the above pretreatment with anthraquinone in which the variation in the solubility of the anthraquinone in an alkaline liquor is used to produce an internal circulation of anthraquinone in a treatment zone. This internal circulation results from the variation in the solubility of anthraquinone which occurs in a counter-current treatment of cellulose. The AQ-containing solution is introduced at one end of a counter-current treatment zone at higher alkalinity where the AQ is more soluble. This high alkalinity is effected by also introducing highly-alkaline kraft white liquor while introducing the AQ to the cellulose. The alkalinity of the counter-current flowing liquid decreases as the alkali is consumed by the cellulose material such that the alkalinity of the AQ solution is reduced to a point where the AQ becomes insoluble and precipitates onto the cellulose. The down-flowing cellulose then carries the precipitated AQ back into the other end of the treatment zone where the alkalinity is higher such that the AQ again dissolves. The dissolved AQ then passes back counter-currently to the flow of cellulose and the cycle repeats itself. Though this process provides for the recovery and re-use of anthraquinone it is not applicable to treatments with other additives, such as polysulfide or sulfur, which are not characterized by such variation in solubility due to alkalinity.

Recently, U.S. Pat. Nos. 6,241,851 and 6,576,084 have issued which are improvements on the AQ-pulping processes as described above. Furthermore, certain bleaching sequences and bleaching stages are well-known in the art, such as those disclosed in U.S. Pat. Nos. 6,153,300 and 6,010,594 and EP 0786 029 B1.

Notwithstanding the advances in this art with respect to AQ cooking processes, some improvements are needed, especially in terms of bleaching following cooking with soda and AQ. The techniques described herein are therefore directed toward providing such improvements.

BRIEF SUMMARY OF THE INVENTION

An aspect of the present invention generally relates to a process for a bleaching of lignocellulosic pulp comprising the steps of: cooking of a lignocellulosic material with soda and anthraquinone to form a lignocellulosic pulp, wherein the soda comprises sodium hydroxide, sodium carbonate, or sodium hydroxide and sodium carbonate; feeding the lignocellulosic pulp to a first stage in which the lignocellulosic pulp contacts a first alkali containing oxygen; removing the lignocellulosic pulp from the first stage and feeding the lignocellulosic pulp to a second stage in which the lignocellulosic pulp contacts an acid; removing the lignocellulosic pulp from the second stage and feeding the lignocellulosic pulp to a third stage in which the lignocellulosic pulp contacts a first chlorine dioxide or a first chlorine dioxide and an ozone; removing the lignocellulosic pulp from the third stage and feeding the lignocellulosic pulp to a fourth stage in which the lignocellulosic pulp contacts a second alkali and a hydrogen peroxide; removing the lignocellulosic pulp from the fourth stage and feeding the lignocellulosic pulp to a fifth stage of further bleaching in which the lignocellulosic pulp contacts a second chlorine dioxide and/or other bleaching chemicals in one or more stages to achieve a final brightness higher than 89 (% ISO); and removing the lignocellulosic pulp from the fifth stage.

Another aspect of the present invention may generally relate to a process for a bleaching of lignocellulosic pulp comprising the steps of: cooking a lignocellulosic material with soda and anthraquinone to form a lignocellulosic pulp; feeding the lignocellulosic pulp to a first stage in which the lignocellulosic pulp contacts a first alkali containing oxygen; removing the lignocellulosic pulp from the first stage and feeding the lignocellulosic pulp to a second stage in which the lignocellulosic pulp contacts an acid at a temperature greater than 105° C.; removing the lignocellulosic pulp from the second stage and feeding the lignocellulosic pulp to a third stage in which the lignocellulosic pulp contacts a chlorine dioxide or a chlorine dioxide and an ozone; and removing the lignocellulosic pulp from the third stage.

In at least some embodiments of the present invention, there is a cooking followed by bleaching process for cooking with soda and anthraquinone (AQ) that may allow for substantially similar if not the same brightness and charges (bleaching chemical charges) and other pulp strength properties to be achieved as those realized from kraft cooking. In at least certain embodiments, wood chips (or other cellulosic material) are treated with or without carbonate (C) prior to cooking with soda AQ and then are subjected to a bleaching sequence where an acid (A) stage at high temperature (e.g., greater than 105° C. or 110° C.) may be followed by an optional wash and ozone (Z) or ozone combined with chlorine dioxide (Z/D) stages the brightness, chemical charges and other pulp strength properties are comparable to those associated with conventional Kraft cooking using similar bleaching sequences.

BRIEF DESCRIPTION OF THE DRAWINGS

FIG. 1 schematically illustrates a bleaching sequence in accordance with an exemplary embodiment of the invention.

DETAILED DESCRIPTION OF THE INVENTION

The cooking with soda AQ with or without a C stage before the cooking and conventional bleaching sequences such as O-A/D-Eop-D, O-Z/D-Eop-D, and O-Do-Eop-D does not result in a bleached pulp of the same brightness as Kraft pulp. (Eop in these sequences represents an extraction stage with oxygen and peroxide.) In accordance with at least certain embodiments of the present invention, beneficial results may be achieved when soda AQ cooking with or without carbonate pretreatment is followed by an acid stage (A) at high temperature then washing followed by an ozone stage (Z) or ozone and chlorine dioxide stage (Z/D). In such a case, the soda AQ pulp is bleached to at least the brightness of Kraft pulp while requiring similar chemical charges as those employed for the Kraft pulp and maintaining other bleached pulp properties, such as tensile properties.

Preferably, the cooking with soda occurs with little or no sulfur (e.g., sodium sulfide) and is not a sulphate process. The cooking with soda prior to bleaching may occur by well-known methods, including, for example, Lo-Solids® soda AQ involving a low dissolved solids content throughout the bulk phase of delignification and to the end of the cook, soda AQ with a carbonate pretreatment, soda AQ with an acid pretreatment, etc. The consistency of the pulp as it exits the digester is preferably at least 5% solids by weight.

While not wishing to be limited to any theory, it is believed that, when practicing a soda AQ cooking process (with or without a carbonate treatment stage), a chemical bond may be formed between the AQ and carbohydrate or a lignin complex which results in the poor bleaching ability when compared to the kraft cooking process.

It is known that for pulps from the kraft cooking process, the acid stage works well for removing the Hex-A (hexenuronic acid). (See, for example, U.S. Pat. Nos. 6,776,876, 6,736,934 and 6,306,253.) For Kraft pulps, this A stage can be followed by one or more chlorine dioxide (D) or ozone (Z) stages where it is not as important to wash between stages. However, for soda AQ pulps, if the A stage is followed by an ozone (Z) or ozone and chlorine dioxide (Z/D) or chlorine dioxide (D) stages, there may be a washing between the A and subsequent stages.

It should be noted that the wash between bleaching stages for pulp produced using soda AQ has been confirmed on a laboratory scale. Thus, in at least certain embodiments, there may preferably be a wash step between bleaching stages. It is also believed that the acid and ozone stages may be especially useful in processes involving bleaching pulp produced by soda AQ cooking.

FIG. 1 schematically illustrates a bleaching sequence in accordance with an exemplary embodiment of the invention. Pulp produced through cooking of the lignocellulosic material with soda and anthraquinone is introduced via line 112 to a first step 110 of bleaching process.

First stage 110 is a stage involving oxygen delignification (i.e., an "O" stage) in which chemical(s), such as alkali and/or hydrogen peroxide, are added via line 114 and contact the pulp. After processing in first stage 110, the pulp is removed via line 122 and fed either directly or indirectly to second stage 120. The contacting may occur between 60 and 90 minutes and at a temperature between 85 and 115° C. The alkali may comprise between 1 and 2 percent by weight of the pulp.

Second stage 120 is a stage involving an acid stage (i.e., an "A" stage) in which chemical(s), such as acid (e.g., $H_2SO_4$), are added via line 124 and contact the pulp. After processing in second stage 120, the pulp is removed via line 132 and fed either directly or indirectly to third stage 130. The contacting may occur between 10 and 150 minutes and at a temperature up to 115° C. In certain embodiments, the temperature may be greater than 105° C. or greater than 110° C. The acid may comprise between 0.25 and 0.75 percent by weight of the pulp.

Third stage 130 is a stage involving an ozone stage (i.e., a "Z" stage) or an ozone and chlorine dioxide stage (i.e., a "ZDo" stage) in which chemical(s), such as ozone and/or chlorine dioxide, are added via line 134 and contact the pulp. After processing in third stage 130, the pulp is removed via line 142 and fed either directly or indirectly to fourth stage 140. The contacting may occur between 10 and 20 minutes and at a temperature between 50 and 110° C. The ozone may comprise between 0.25 and 0.5 percent by weight of the pulp. The chlorine dioxide may comprise between 0.1 and 0.75 percent by weight of the pulp.

Fourth stage 140 is a stage involving an extraction with oxygen and peroxide (i.e., an "Eop" stage) in which chemical(s), such as alkali, hydrogen peroxide, and/or magnesium sulfate, are added via line 144 and contact the pulp. After processing in fourth stage 140, the pulp is removed via line 152 and fed either directly or indirectly to fifth stage 150. The contacting may occur between 60 and 90 minutes and at a temperature between 75 and 105° C. The alkali may comprise between 0.5 and 1.5 percent by weight of the pulp. The hydrogen peroxide may comprise between 0.25 and 0.75 percent by weight of the pulp. The magnesium sulfate may comprise between 0.5 and 1.5 percent by weight of the pulp.

Fifth stage 150 is a stage involving a chlorine dioxide stage (i.e., a "D" stage) in which chemical(s), such as chlorine dioxide, are added via line 154 and contact the pulp. After processing in fifth stage 150, the pulp is removed via line 162. The contacting may occur between 30 and 150 minutes and at a temperature between 50 and 99° C. The chlorine dioxide may comprise between 0.1 and 0.5 percent by weight of the pulp.

In certain embodiments, the pulp may be treated (e.g., washed, filtered, etc.) between stages using known, conventional techniques. In certain embodiments, only the A stage and ZDo or Do may be necessary.

EXAMPLES

Laboratory bleaching of pulps produced using a soda AQ cooking process in accordance with an embodiment of the present invention and a comparative example involving the kraft cooking process method was conducted using the following two bleaching sequences: O-A-Do-Eop-D and O-A-ZDo-Eop-D. Do represents an initial chlorine dioxide stage. O represents a stage involving oxygen delignification.

Table 1 presents the bleaching conditions and brightness received after each bleaching step. These laboratory results show that the brightness achieved after the "D" stage for soda AQ pulps may be at least at the level of that of the kraft pulp when using a similar chemical charge. As is well-known in the art, the Kappa number is an indication of the lignin content or bleachability of pulp.

TABLE 1

Bleaching Conditions and Brightness Received After Each Bleaching Step

| | | C-Soda-AQ pulp | | | | | | | | | Kraft pulp | | | |
|---|---|---|---|---|---|---|---|---|---|---|---|---|---|---|
| | | 15.6 Kappa O-A-Do-Eop-D | | | | 15.6 Kappa O-A-ZDo-Eop-D | | | | | 16.9 Kappa O-A-ZDo-Eop-D | | | 16.9 Kappa O-ADo-Eop-D-P |
| O | Temperature (° C.) | 100 | | | | 100 | | | | | 100 | | | 100 |
| | Time (min) | 75 | | | | 75 | | | | | 75 | | | 75 |
| | Alkali charge (%) | 1.4 | | | | 1.4 | | | | | 1.4 | | | 1.4 |
| | $H_2O_2$ charge (%) | — | | | | — | | | | | — | | | — |
| | Kappa number | 9.9 | | | | 9.7 | | | | | 10.3 | | | 10.3 |
| | Viscosity (mPa · S) | 26.8 | | | | 25.6 | | | | | 47.4 | | | 47.4 |
| | Brightness (% ISO) | — | | | | 62.3 | | | | | 61.8 | | | 61.8 |
| A | Temperature (° C.) | 100 | | | | 90 | | | | | 85 | | | 85 |
| | Time (min) | 120 | | | | 120 | | | | | 120 | | | 120 |
| | Acid charge (%) | 0.44 | | | | 0.56 | | | | | 0.53 | | | 0.52 |
| Z | Temperature (° C.) | — | | | | 60 | | | | | 75 | | | — |
| | Time (min) | — | | | | — | | | | | — | | | — |
| | $O_3$ charge (%) | — | | | | 0.39 | | | | | 0.3 | | | — |
| Do | Temperature (° C.) | 90 | | | | 60 | | | | | 75 | | | 85 |
| | Time (min) | 15 | | | | 15 | | | | | 15 | | | 15 |
| | $ClO_2$ charge (%) | 0.49 | | | | 0.2 | | | | | 0.2 | | | 0.5 |
| | Brightness (% ISO) | 72.5 | | | | 77.3 | | | | | 75.6 | | | 72.6 |
| Eop | Temperature (° C.) | 85 | | | | 85 | | | | | 85 | | | 85 |
| | Time (min) | 75 | | | | 75 | | | | | 75 | | | 75 |
| | Alkali charge (%) | 1 | | | | 1 | | | | | 1 | | | 1 |
| | $H_2O_2$ charge (%) | 0.4 | | | | 0.4 | | | | | 0.4 | | | 0.5 |
| | $MgSO_4$ charge (%) | 0.1 | | | | 0.1 | | | | | 0.1 | | | 0.1 |
| | Kappa number | 1.7 | | | | 1 | | | | | 2.2 | | | 2.8 |
| | Viscosity (mPa · S) | — | | | | 11.9 | | | | | 21.6 | | | 34.4 |
| | Brightness (% ISO) | 84.4 | | | | 85.8 | | | | | 86.3 | | | 86.3 |
| D | Temperature (° C.) | 70 | | | | 70 | | | | | 75 | | | 75 |
| | Time (min) | 120 | | | | 120 | | | | | 120 | | | 120 |
| | $ClO_2$ charge (%) | — | 0.3 | 0.4 | 0.2 | 0.3 | 0.4 | 0.2 | 0.3 | 0.4 | | | | 0.2 |
| | Viscosity (mPa · S) | — | — | 18.5 | 12.3 | 21.5 | — | — | — | | | | | |
| | Brightness (% ISO) | — | 89.1 | 89.8 | 91 | 91.3 | 91.6 | 90.6 | 91.4 | 92 | | | | 89 |
| P | Temperature (° C.) | | — | | | — | | | — | | | | | 80 |
| | Time (min) | | — | | | — | | | — | | | | | 120 |
| | $MgSO_4$ charge (%) | | — | | | — | | | — | | | | | 0.1 |

TABLE 1-continued

| Bleaching Conditions and Brightness Received After Each Bleaching Step | | | | |
|---|---|---|---|---|
| | C-Soda-AQ pulp | | Kraft pulp | |
| | 15.6 Kappa O-A-Do-Eop-D | 15.6 Kappa O-A-ZDo-Eop-D | 16.9 Kappa O-A-ZDo-Eop-D | 16.9 Kappa O-ADo-Eop-D-P |
| $H_2O_2$ charge (%) | — | — | — | 0.3 |
| Viscosity (mPa · S) | — | — | — | — |
| Brightness (% ISO) | — | — | — | 91.9 |

Table 2 presents the bleaching conditions and brightness received after each bleaching step in accordance with another embodiment. In this embodiment, the "A" stage was at 110° C. and lasted for 30 minutes, and the "D" stage lasted 15 minutes. The Bleaching sequence was O-A-D-Eop-D. In the table, the "A-D" stages are presented together.

| | Bleaching Sequence: O-A-D-Eop-D | | |
|---|---|---|---|
| Kappa Number | 16.2 | | |
| Chlorited viscosity, mPa · s | 42.1 | | |
| ISO Brightness, % | 39.4 | | |
| DCM Extractives, % | 0.17 | | |
| (O) Stage: 100° C., 75 min., 80 psi., 10% cons. | | | |
| NaOH, % | 1.4 | | |
| Final pH | 10.8 | | |
| Kappa Number | 9.9 | | |
| Viscosity, mPa · s | 31.5 | | |
| ISO Brightness, % | 57.7 | | |
| HexA, meq/kg | 51.4 | | |
| DCM Extractives, % | 0.16 | | |
| (A-D) Stage: 110° C. + 85° C. 10% cons. | A stage final pH: 3 | | |
| $H_2SO_4$, % | 0.56 | | |
| $ClO_2$, % | 0.68 | | |
| NaOH, % | 0.25 | | |
| Time, min. | 30 + 15 | | |
| Consumed $ClO_2$, % | 0.68 | | |
| Final pH A stage | 3.0 | | |
| Final pH D stage | 2.2 | | |
| ISO Brightness, % | 79.7 | | |
| HexA, meq/kg | 8.3 | | |
| Eop Stage: 85° C., 60 min., 60 psi, 10% cons. | | | |
| NaOH, % | 1.0 | | |
| $H_2O_2$, % | 0.5 | | |
| $MgSO_4$, % | 0.1 | | |
| Final pH | 11.0 | | |
| Consumed $H_2O_2$, % | 0.30 | | |
| Kappa Number | 0.9 | | |
| Viscosity, mPa · s | 18.0 | | |
| ISO Brightness, % | 86.4 | | |
| DCM Extractives, % | 0.10 | | |
| D Stage: 70° C., 120 min., 10% cons. | | | |
| $ClO_2$, % | 0.3 | 0.5 | 0.7 |
| Total $ClO_2$ Charge, kg/Admt | 8.82 | 10.62 | 12.42 |
| Total $ClO_2$ Charge, kg/ADMt as act. Cl | 23.20 | 27.93 | 32.66 |
| $H_2SO_4$, % | 0.13 | — | — |
| NaOH, % | — | — | 0.04 |
| Final pH | 4.0 | 4.1 | 4.2 |
| $ClO_2$ Consumed, % | 0.29 | 0.48 | 0.66 |
| ISO Brightness, % | 90.9 | 91.2 | 91.6 |
| Viscosity, mPa · s | — | — | 16.7 |
| DCM Extractives, % | — | — | 0.08 |

All described and claimed numbers and numerical ranges are approximate and include at least some degree of variation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

What is claimed is:

1. A process for a bleaching of lignocellulosic pulp comprising the steps of:

cooking a lignocellulosic material with soda and anthraquinone to form a lignocellulosic pulp, wherein the soda comprises sodium hydroxide, sodium carbonate, or sodium hydroxide and sodium carbonate; wherein the cooking essentially excludes sulfides;

feeding the lignocellulosic pulp to a first stage in which the lignocellulosic pulp contacts oxygen and a first alkali, wherein the first alkali comprises between 1 and 2 percent by weight of the lignocellulosic pulp;

removing the lignocellulosic pulp from the first stage and feeding the lignocellulosic pulp to a second stage in which the lignocellulosic pulp contacts an acid wherein the acid comprises between 0.25 and 0.75 percent by weight of the pulp;

removing the lignocellulosic pulp from the second stage and feeding the lignocellulosic pulp to a third stage in which the lignocellulosic pulp contacts a first chlorine dioxide, wherein the first chlorine dioxide comprises between 0.1 and 0.75 percent by weight of the lignocellulosic pulp;

removing the lignocellulosic pulp from the third stage and feeding the lignocellulosic pulp to a fourth stage in which the lignocellulosic pulp contacts a second alkali and a hydrogen peroxide, wherein the second alkali comprises between 0.5 and 1.5 percent by weight of the lignocellulosic pulp, and wherein the hydrogen peroxide comprises between 0.25 and 0.75 percent by weight of the lignocellulosic pulp;

removing the lignocellulosic pulp from the fourth stage and feeding the lignocellulosic pulp to a fifth stage of further bleaching in which the lignocellulosic pulp contacts a second chlorine dioxide and/or other bleaching chemicals in one or more stages to achieve a final brightness higher than 89 (% ISO) wherein the second chlorine dioxide comprises between 0.1 and 0.5 percent by weight of the lignocellulosic pulp; and removing the lignocellulosic pulp from the fifth stage.

2. The process of claim 1, wherein the contacting in the second stage occurs between 10 and 150 minutes and at a temperature greater than 105° C.

3. The process of claim 1, wherein a brightness higher than 90% ISO brightness is achieved.

4. The process of claim 1, wherein a brightness higher than 91% ISO brightness is achieved.

5. The process of claim 1, wherein a brightness higher than 92% ISO brightness is achieved.

6. The process of claim 1, further comprising the step of washing the lignocellulosic pulp after at least one of any of the first stages, the second stage, the third stage, the fourth stage, and the fifth stage.

7. The process of claim 1, wherein the acid $H_2SO_4$.

8. The process of claim 7, wherein the first alkali comprises alkali, hydrogen peroxide, or both alkali and hydrogen peroxide, the second alkali comprises alkali, hydrogen peroxide, or both alkali and hydrogen peroxide and wherein the method further comprises contacting in the third stage the lignocellulosic pulp with an ozone, wherein the ozone comprises between 0.25 and 0.5 percent by weight of the lignocellulosic pulp, and contacting the lignocellulosic pulp in the fourth stage with a magnesium sulfate comprises between 0.5 and 1.5 percent by weight of the lignocellulosic pulp.

9. The process of claim 1, wherein the step of cooking of a lignocellulosic material involves a low dissolved solids content throughout delignification.

10. The process of claim 1, further comprising the step of pretreating the lignocellulosic material with carbonate or acid prior to cooking.

11. The process of claim 2, wherein the contacting in the second stage occurs at a temperature greater than 110° C.

12. The process of claim 1, wherein a consistency of the lignocellulosic pulp fed to the first stage comprises greater than 5% solids by weight.

13. A process for a bleaching of lignocellulosic pulp comprising the steps of:

cooking a lignocellulosic material with soda and anthraquinone to form a lignocellulosic pulp; wherein the cooking essentially excludes sulfides;

feeding the lignocellulosic pulp to a first stage in which the lignocellulosic pulp contacts oxygen and a first alkali, wherein the first alkali comprises between 1 and 2 percent by weight of the lignocellulosic pulp;

removing the lignocellulosic pulp from the first stage and feeding the lignocellulosic pulp to a second stage in which the lignocellulosic pulp contacts an acid at a temperature greater than 105° C., wherein the acid comprises between 0.25 and 0.75 percent by weight of the pulp;

removing the lignocellulosic pulp from the second stage and feeding the lignocellulosic pulp to a third stage in which the lignocellulosic pulp contacts a chlorine dioxide, wherein the chlorine dioxide comprises between 0.1 and 0.75 percent by weight of the lignocellulosic pulp; and removing the lignocellulosic pulp from the third stage.

14. The process of claim 13, wherein the contacting in the second stage occurs between 10 and 150 minutes and at a temperature greater than 110° C.

15. The process of claim 13, wherein a brightness higher than 89% ISO brightness is achieved.

16. The process of claim 13, wherein a brightness higher than 90% ISO brightness is achieved.

17. The process of claim 13, wherein a brightness higher than 91% ISO brightness is achieved.

18. The process of claim 13, wherein a brightness higher than 92% ISO brightness is achieved.

19. The process of claim 13, further comprising the step of washing the lignocellulosic pulp after at least one of any of the first and second stages.

20. The process of claim 13, wherein the acid comprises $H_2SO_4$.

21. The process of claim 13, further comprising contacting in the third stage the lignocellulosic pulp with an ozone, wherein the ozone comprises between 0.25 and 0.5 percent by weight of the lignocellulosic pulp.

22. The process of claim 13, wherein the step of cooking of a lignocellulosic material involves a low dissolved solids content throughout delignification.

23. The process of claim 13, further comprising the step of pretreating the lignocellulosic material with carbonate or acid prior to cooking.

24. The process of claim 13, wherein a consistency of the lignocellulosic pulp fed to the first stage comprises greater than 5% solids by weight.

* * * * *